US012760721B2

(12) United States Patent
Wu et al.

(10) Patent No.: US 12,760,721 B2
(45) Date of Patent: Oct. 13, 2026

(54) FOUR-CYLINDER COMPRESSOR

(71) Applicant: FOSHAN MIC MEDICAL TECHNOLOGY CO., LTD., Foshan (CN)

(72) Inventors: Huahong Wu, Foshan (CN); Linhai Chen, Foshan (CN)

(73) Assignee: FOSHAN MIC MEDICAL TECHNOLOGY CO., LTD., Foshan (CN)

( * ) Notice: Subject to any disclaimer, the term of this patent is extended or adjusted under 35 U.S.C. 154(b) by 17 days.

(21) Appl. No.: 18/497,684

(22) Filed: Oct. 30, 2023

(65) Prior Publication Data

US 2024/0060483 A1 Feb. 22, 2024

Related U.S. Application Data

(63) Continuation of application No. PCT/CN2023/101809, filed on Jun. 21, 2023.

(30) Foreign Application Priority Data

Oct. 24, 2022 (CN) ..... 202211307310.9
May 29, 2023 (CN) ..... 202321327217.4

(51) Int. Cl.
*F04B 27/02* (2006.01)
*F04B 39/12* (2006.01)

(52) U.S. Cl.
CPC ..... *F04B 27/02* (2013.01); *F04B 39/12* (2013.01)

(58) Field of Classification Search
CPC ..... F04B 27/02; F04B 39/12
USPC ..... 417/415, 419
See application file for complete search history.

(56) References Cited

U.S. PATENT DOCUMENTS 2,668,004 A * 2/1954 Browne ..... F04B 39/0261 417/415
5,326,231 A * 7/1994 Pandeya ..... F04B 39/14 92/72
6,431,845 B1 * 8/2002 Thomas ..... F04B 27/02 417/415
6,716,003 B2 * 4/2004 Chen ..... F04B 35/01 417/415

(Continued)

FOREIGN PATENT DOCUMENTS

CN 206972467 U 2/2018
CN 107762781 A 3/2018

(Continued)

OTHER PUBLICATIONS

CN-107762781-A; Mar. 6, 2018.*
CN-207145162-U; Mar. 27, 2018.*
CN-206972467-U; Feb. 6, 2018.*

*Primary Examiner* — Christopher S Bobish

(57) ABSTRACT

A four-cylinder compressor, including a hollow base placed horizontally, a motor body fixed in the base, a cam mechanism in transmission connection to output shafts at two ends of the motor body and two cylinder groups arranged at the base. The cylinder groups are in transmission connection with the cam mechanism, each including a first cylinder and a second cylinder. The first cylinder and the second cylinder are fixedly arranged opposite to each other on the base along the vertical direction. The two first cylinders are connected, and the two second cylinders are connected.

8 Claims, 12 Drawing Sheets

(56) References Cited

U.S. PATENT DOCUMENTS

| | | | | |
|---|---|---|---|---|
| 6,776,587 | B2 * | 8/2004 | Meyer | F04B 25/00 417/248 |
| 6,832,900 | B2 * | 12/2004 | Leu | F04B 39/0027 417/523 |
| 6,890,158 | B2 * | 5/2005 | Graber | F04B 39/066 417/368 |
| 7,654,802 | B2 * | 2/2010 | Crawford, Jr. | F04B 35/04 74/44 |
| 8,128,382 | B2 * | 3/2012 | Smits | F04B 39/12 417/415 |
| 8,128,385 | B2 * | 3/2012 | Takemi | F04B 39/1013 137/856 |
| 2006/0222530 | A1 * | 10/2006 | Huang | H02K 9/06 417/415 |

FOREIGN PATENT DOCUMENTS

| | | | |
|---|---|---|---|
| CN | 207145162 | U | 3/2018 |
| CN | 210164597 | U | 3/2020 |
| CN | 214741902 | U | 11/2021 |
| CN | 115559877 | A | 1/2023 |
| JP | 2008008269 | A | 1/2008 |

* cited by examiner

FOUR-CYLINDER COMPRESSOR

CROSS-REFERENCE TO RELATED APPLICATIONS

This application is a continuation of International Patent Application No. PCT/CN2023/101809, filed on Jun. 21, 2023, which claims the benefit of priority from Chinese Patent Application Nos. 202211307310.9 and 202321327217.4, filed on Oct. 24, 2022 and May 29, 2023, respectively. The content of the aforementioned applications, including any intervening amendments made thereto, is incorporated herein by reference in its entirety.

TECHNICAL FIELD

This application relates to compressors, and more particularly to a four-cylinder compressor.

BACKGROUND

Oil-free compressor is a kind of mechanically-operated fluid machinery capable of raising the gas pressure, and is considered as the heart of the medical oxygen concentrator systems. During the operation process, low-temperature and low-pressure purified air is sucked from a suction hose and compressed by a piston driven by a motor, and high-temperature, high-pressure and oil-free clean gas is discharged through the discharge tube, which can serve as the air source for the oxygen-generation cycle of a molecular sieve oxygen concentrator.

Most of the existing compressors are two-cylinder compressors, where two cylinders are installed on the same side. The compressor is vertically arranged in the equipment such that air is discharged through the two upper cylinders when the compressor is started.

However, since the two cylinders are installed on the same side, the vertical arrangement of the compressor will render the overall center of gravity too high during the operation, resulting in poor stability, high power loss, and weak reliability.

SUMMARY

In view of the shortcomings of the prior art, the present disclosure provides a four-cylinder compressor with low overall center of gravity, excellent running stability and high reliability.

Technical solutions of the present disclosure are described as follows.

This application provides a four-cylinder compressor, comprising:

a base;

a motor body;

a cam mechanism;

a first cylinder group; and a second cylinder group;

wherein the base is hollow, and is placed horizontally; the motor body is fixedly arranged in the base; the cam mechanism is in transmission connection with output shafts at both ends of the motor body; the first cylinder group and the second cylinder group are relatively arranged on left and right sides of the base; each of the first cylinder group and the second cylinder group includes a first cylinder and a second cylinder; the first cylinder and the second cylinder are both in transmission connection with the cam mechanism, and the first cylinder and the second cylinder are fixed on the base opposite to each other along a vertical direction; the first cylinder of the first cylinder group is communicated with the first cylinder of the second cylinder group; and the second cylinder of the first cylinder group is communicated with the second cylinder of the second cylinder group.

In an embodiment, the base includes a motor housing, a first end housing and a second housing. The first end housing and the second end housing are arranged at two sides of the motor housing respectively. The motor body is fixedly provided in the motor housing. The cam mechanism is arranged in the first housing and the second housing; the first cylinder and the second cylinder of the first cylinder group are arranged opposite to each other at upper and lower sides of the first end housing, respectively. The first cylinder and the second cylinder of the second cylinder group are arranged opposite to each other at upper and lower sides of the second end housing, respectively.

In an embodiment, the cam mechanism includes a cam fixed on the output shafts of the motor body, a first connecting rod, a second connecting rod, a first piston and a second piston. The first connecting rod and the second connecting rod are sleeved on the cam. The first piston is provided on the first connecting rod. The second piston is provided on the second connecting rod. The first connecting rod and the second connecting rod are perpendicular to the output shafts. The second connecting rod is arranged near the motor body. The first piston is in transmission connection with the first cylinder, and the second piston is in transmission connection with the second cylinder.

In an embodiment, a side of the base is horizontally and fixedly provided with a mounting base.

In an embodiment, the four-cylinder compressor further includes a first support assembly and a second support assembly; the first support assembly and the second support assembly are arranged at left and right positions of the motor body. And the first support assembly and the second support assembly are located between the motor body and the cam mechanism.

Each of the first support assembly and the second support assembly includes a fixed plate and a support bearing; the fixed plate is arranged on the base; the support bearing is arranged on the fixed plate. The support bearing is sleeved on the output shafts of the motor body.

A first end cover and a second end cover are fixedly provided at left and right ends of the base respectively. Each of the first end cover and the second end cover is provided with a shaft sleeve, and two shaft sleeves are coaxially fixed on the output shafts of the main body of the motor body, respectively.

In an embodiment, the first end housing and the second end housing are each provided with an accommodating cavity to accommodate the output shafts and the cam mechanism, and the accommodating cavity has a sealed structure whose inside and outside are separated.

In an embodiment, the first end housing and the second end housing are provided with the accommodating cavity to accommodate the output shafts and the cam mechanisms, and a side wall of the accommodating cavity is provided with a function hole.

In an embodiment, the base includes a sealing plug; the sealing plug is removably arranged in the function hole.

In an embodiment, the first cylinder and the second cylinder each include a cylinder liner, a valve plate and a cylinder cover.

The cylinder liner of the first cylinder and the cylinder liner of the second cylinder are arranged opposite to each other at the base along a vertical direction. The first piston is arranged in the cylinder liner of the first cylinder, and the second piston is arranged in the cylinder liner of the second cylinder. The valve plate is arranged in the cylinder liner, and the cylinder cover is provided on the valve plate. The cylinder cover is provided with an air cavity, and a portion of the valve plate located within the air cavity is provided with a cylinder air hole and a gas delivery passage.

The cylinder air hole is connected with an interior of the cylinder liner and the air cavity. And one end of the gas delivery passage is connected with the air cavity, and the other end of the gas delivery passage is connected with outside of the valve plate.

In an embodiment, outer side walls of the valve plate are respectively provided with an air inlet and an air outlet of the gas delivery passage.

In an embodiment, the four-cylinder compressor further includes a cylinder connecting pipe.

The valve plate is provided with a connection port at the gas delivery passage, and the connection port is located between the air inlet and the air outlet of the gas delivery passage. One end of the cylinder connecting pipe is connected with the connection port of the valve plate in the first cylinder group, and the other end of the cylinder connecting pipe is connected with the connection port of the valve plate in the second cylinder group.

In an embodiment, the number of the air cavity on the end cover is two, the number of the cylinder air hole on the valve plate is two, and two cylinder air holes are in one-to-one correspondence with two air cavities. The cylinder air hole is connected with an interior of the cylinder liner and the air cavity. Each of the two cylinder air holes is provided with a suction plate which is resettable and adjustable. The suction plate is configured to move to attach to or detach from the two cylinder air holes, so as to make two ends of each of the two cylinder air holes isolated or connected.

In an embodiment, the cam mechanism includes a first bearing and a second bearing.

The cam is connected with the first connecting rod through the first bearing, and the cam is connected with the second rod through the second bearing.

In an embodiment, the four-cylinder compressor further includes a fan. The fan is connected with the output shafts at the two ends of the motor body.

Compared to the prior art, the present disclosure has the following beneficial effects.

The four-cylinder compressor designed herein has low overall center of gravity, excellent running stability and reliability, and superior vibration performance.

Figure 1:
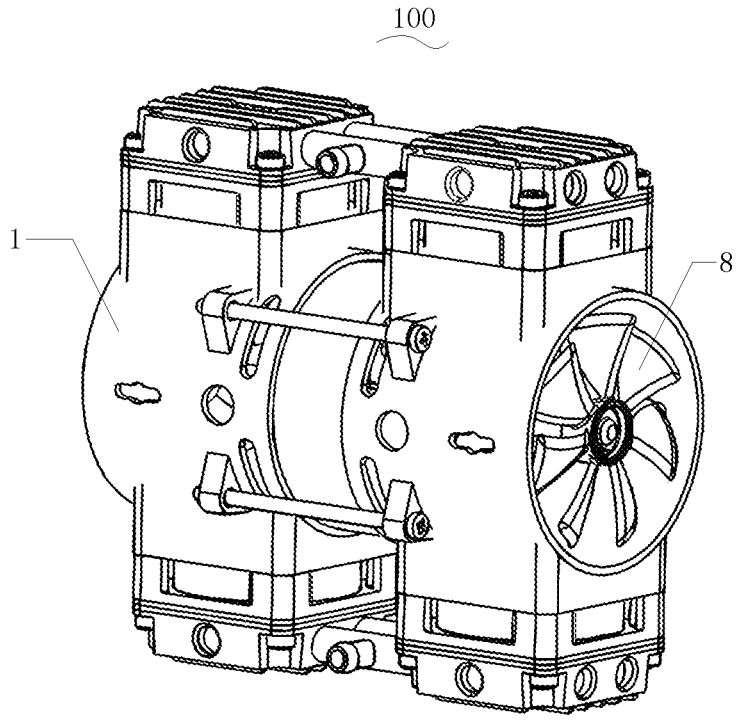
FIG. 1 is a schematic diagram of an overall structure of a four-cylinder compressor according to an embodiment of the present disclosure.
Figure 2:
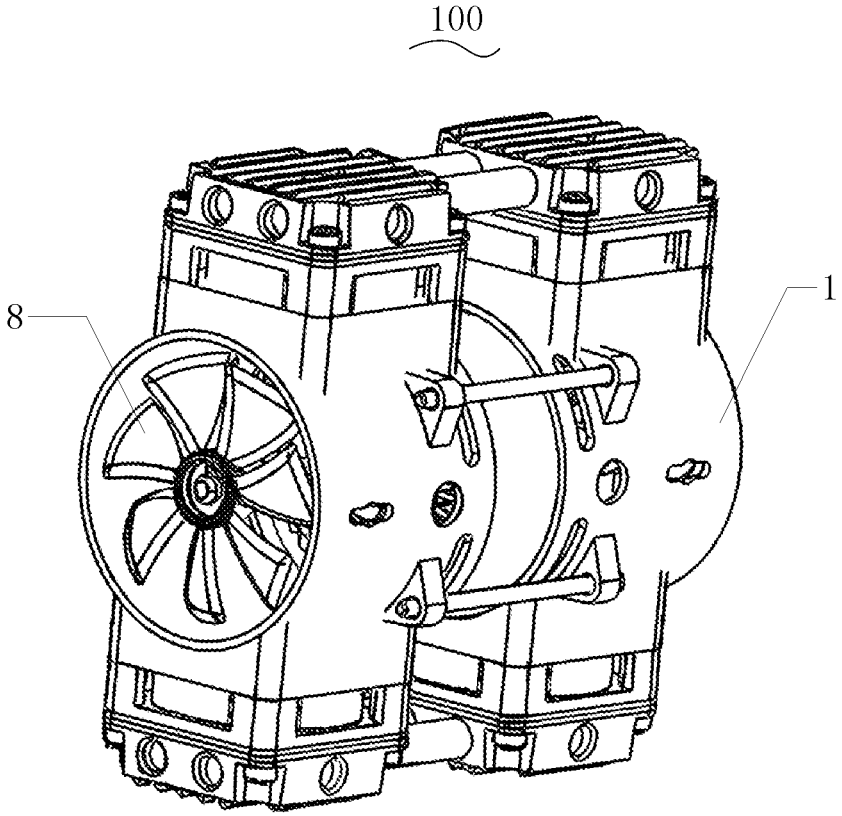
FIG. 2 schematically illustrates the overall structure of the four-cylinder compressor according to an embodiment of the present disclosure.
Figure 3:
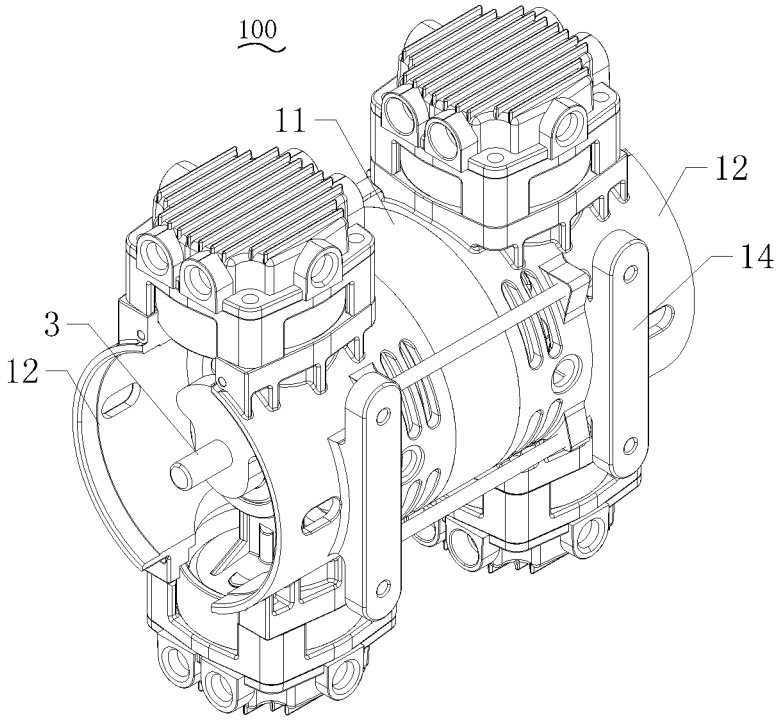
FIG. 3 schematically illustrates the overall structure of the four-cylinder compressor according to an embodiment of the present disclosure.
Figure 4:
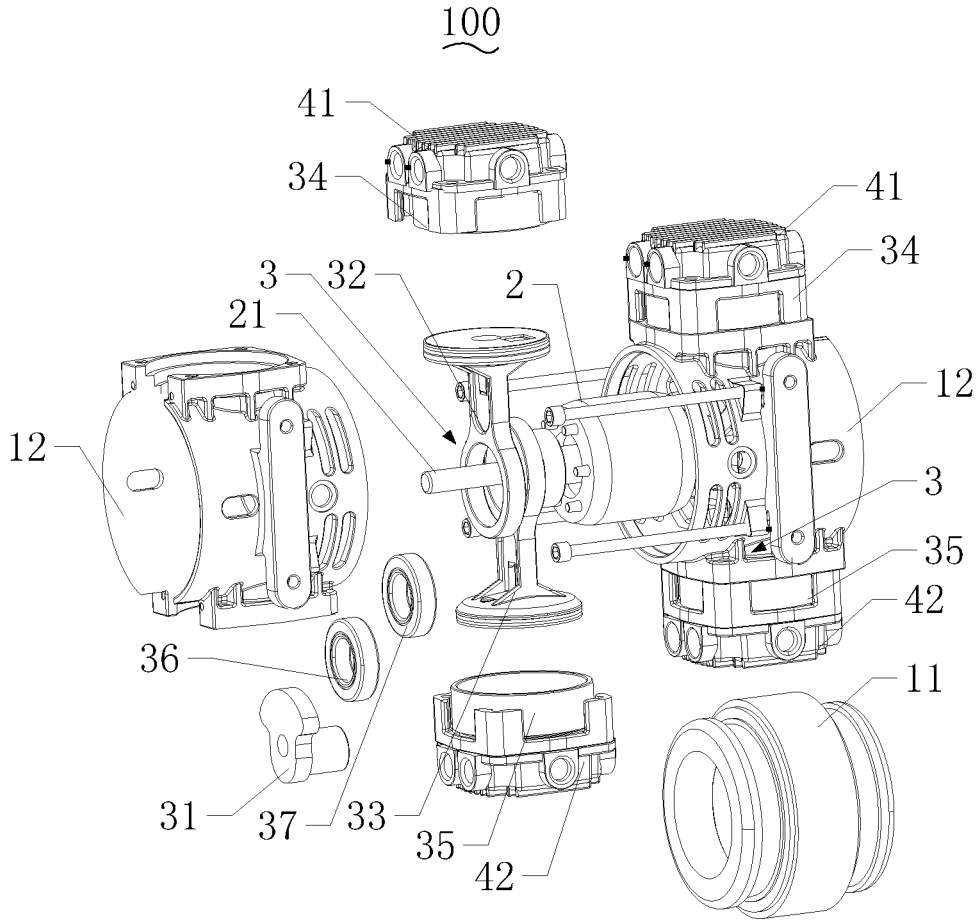
FIG. 4 is an exploded view of the four-cylinder compressor shown in FIG. 3.
Figure 5:
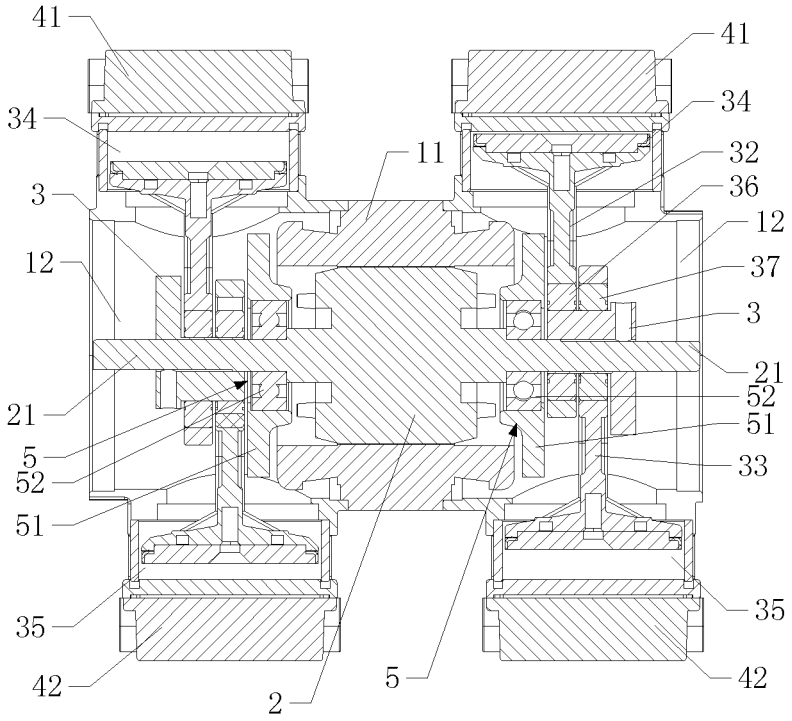
FIG. 5 is a cutaway view of the four-cylinder compressor according to an embodiment of the present disclosure.
Figure 6:
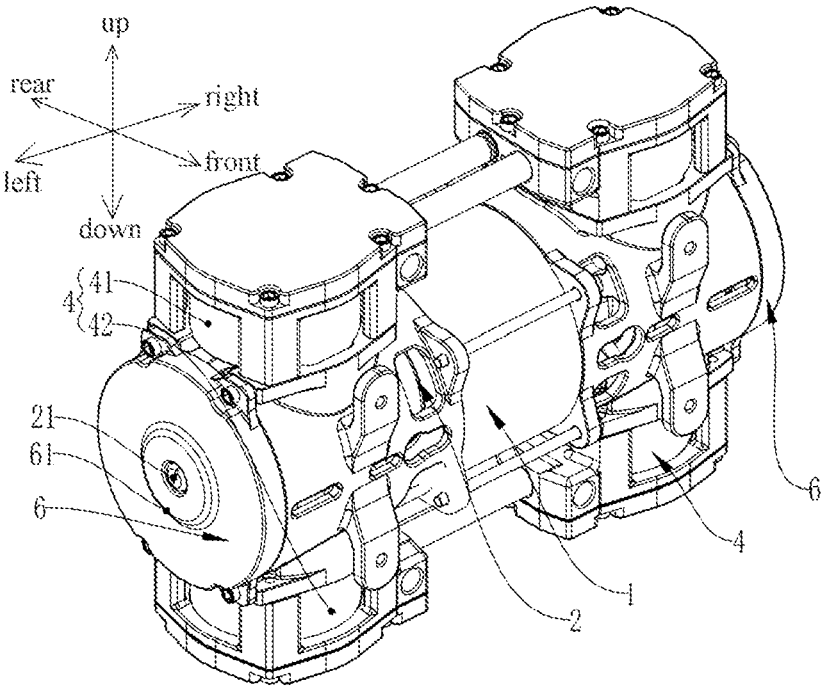
FIG. 6 is a schematic diagram of the structure of the four-cylinder compressor according to an embodiment of the present disclosure.
Figure 7:
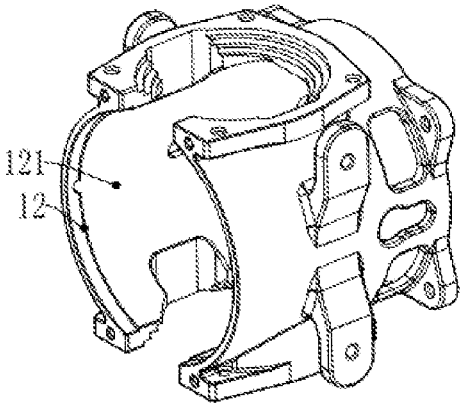
FIG. 7 is a schematic diagram of a structure of an end housing according to an embodiment of the present disclosure.

100—four-cylinder compressor;

1—base; 2—motor body; 3—cam mechanism; 4—cylinder group; 5—support assembly; 6—end cover; 7—cylinder connecting pipe; 8—fan;

11—motor housing; 12—end housing; 13—sealing plug; 14—mounting base; 121—accommodating cavity; 122—function hole;

21—output shaft;

31—cam; 32—first connecting rod; 33—second connecting rod; 34—first piston; 35—second piston; 36—first bearing; 37—second bearing;

41—first cylinder; 42—second cylinder; 411—cylinder liner; 412—valve plate; 413—cylinder cover; 414—air cavity; 415—cylinder air hole; 416—gas delivery passage; 417—air inlet; 418—air outlet; 419—suction plate; 410—connection port;

51—fixed plate; 52—support bearing; and 61—shaft sleeve.

DETAILED DESCRIPTION OF EMBODIMENTS

The technical schemes of the disclosure will be described clearly and completely below with reference to the embodiments and accompanying drawings. Obviously, the embodiments described herein are merely some embodiments of this application rather than all embodiments. Based on the embodiments provided herein, all other embodiments obtained by those of ordinary skill in the art without making creative effort shall fall within the scope of the disclosure.

It should be understood that as used herein, the orientation or position relationship indicated by the terms "center", "longitudinal", "transverse", "length", "width", "thickness", "up", "down", "front", "back", "left", "right", "vertical", "horizontal", "top", "bottom", "inside", "outside", "clockwise", "counter-clockwise" indicate is based on the orientation or position relationship shown in the accompanying drawings, and are only for facilitating and simplifying the description rather than indicating or implying that the devices or components must have a particular orientation, or be constructed and operated in a particular orientation, therefore, they can't be understood as a limitation of this application. Besides, the terms "first" and "second" are only used for description, and can't be understood as indicating or implying relative importance, or implying and indicating the number of referred technical features. Therefore, once a feature is defined with "first" or "second", it may expressly or impliedly indicate the presence of one or more of such features. As used herein, "multiple" means two or more unless otherwise clearly stated.

The technical solutions of this application will be further described with reference to the embodiments and accompanying drawings.

As shown in FIGS. 1-12, a four-cylinder compressor 100 is provided, including a base 1, a motor body 2, a cam mechanism 3, and two cylinder groups 4.

The base 1 is hollow, and is placed horizontally. The motor body 2 is fixedly arranged in the base 1. The cam mechanism 3 is in transmission connection with output shafts 21 at both ends of the motor body 2. The two cylinder groups 4 are arranged on left and right sides of the base 1, respectively, each including a first cylinder 41 and a second cylinder 41. The first cylinder 41 and the second cylinder 41 are in transmission connection with the cam mechanism 3, and are fixed on the base 1 opposite to each other along the vertical direction. The two first cylinders 41 are connected, and the two second cylinders 42 are connected.

Specifically, the hollow base 1 is configured for arrangement of the motor body 2, the cam mechanism 3 and a fan 8. Two sides of the base 1 corresponding to the cam mechanism 3 are each provided with four through holes, and the first cylinders 41 and the second cylinders 42 are connected to the four through holes, respectively, so that four cylinders are connected with the cam mechanism 3.

Specifically, the motor body 2 is a coaxial motor with double-ended output. The output shafts 21 of the motor body 2 are in transmission connection with the cam mechanism 3. The motor body 2 is configured to drive the cam mechanisms 3 at the left and right sides, so as to adjust the first cylinders 41 and the second cylinders 42 to compress air.

Specifically, the motor body 2 drives the cam mechanism 3 two ends of the motor body 2 so that the cam mechanism 3 on left and right positions compress air in the first cylinder 41 and air in the second cylinder 42 respectively. The four cylinders are arranged on the opposite sides of the base 1 so that the two cylinder groups 4 can form a horizontal symmetrical structure during the operation. The horizontal arrangement makes the cylinder groups' center of gravity be low. Because of the horizontal arrangement of the base 1, the first cylinder 41 and the second cylinder 42 on the left and right positions are equivalent to a flat state, which decreases the center of gravity of whole machine and enhances the operating stability of the whole machine. At the same time, the horizontal arrangement of the two cylinder groups 4 brings a symmetrical and stable structure, which makes the compressor operate smoothly and minimizes the power loss during operation. The lower center of gravity and balanced distribution also bring better reliability of vibration and noise reduction to the whole machine.

In any embodiment, the base 1 includes a motor housing 11 a first end housing 12 and a second housing 12. The first end housing and the second end housing are arranged at two sides of the motor housing. The motor body 2 is fixedly provided in the motor housing 11, and the cam mechanism 3 is arranged in the end housings 12; the first cylinder 41 and the second cylinder 42 of the first cylinder group 4 are arranged opposite to each other at upper and lower sides of the first end housing 12, respectively; and the first cylinder 41 and the second cylinder 42 of the second cylinder group 4 are arranged opposite to each other at upper and lower sides of the second end housing 12, respectively.

Specifically, an inner of the motor housing 11 is convenient to fix the motor body 2. The end housing 12 is fixed as a whole by two sides of the motor housing 11. An interior of the end housing 12 is configured for the arrangement of the cam mechanism 3. Structure of two end housings 12 are the same and structures of the two cam mechanisms 3 are the same. The horizontal placement of the symmetrical structure of the end housings 12 makes their center of gravity low, and can enhance the running stability of the whole machine.

Meanwhile, the motor housing 11 is configured to install the motor body 2, and the end housing 12 on the two sides of the motor housing 11 are configured to accommodate the cam mechanism 3; an end cover 6 cover an opening of an end of the end housing 12; when the output shafts 21 are moving in the motor housing 11 and the end housing 12, the end cover 6 will block internal noise and reduce the noise generated during the output shafts 21 moving so as to achieve the effect of noise reduction.

In any embodiment, the cam mechanism 3 includes a cam 31 fixed on the output shaft 21, a first connecting rod 32 and a second connecting rod 33 attached to the cam 31, a first piston 34 arranged on the first connecting rod 32, and a second piston 35 arranged on the second connecting rod 33. The first connecting rod 32 and the second connecting rod 33 are perpendicular to the output shafts 21. The second connecting rod 33 is arranged near the motor body 2. The first piston 34 is in transmission connection with the first cylinder 41, and the second piston 35 is in transmission connection with the second cylinder 42.

Specifically, the motor body 2 drives the output shafts 21 to drive cam 31 to rotate, so that the first connecting rod 32 and the second connecting rod 33 arranged on the cam 31 perform crank mechanism movement. The first connecting rod 32 is configured to adjust compression or relaxation of the first piston 34 so as to adjust compression of the first cylinder 41. The second connecting rod 33 is configured to adjust the compression or relaxation of the second piston 35 so as to adjust the compression of the second cylinder 42. The first connecting rod 32 is arranged on one side of the second connecting rod 33, the second connecting rod 33 is arranged near the motor body 2. When the motor body 2 starts, the output shafts 21 drive the cam 31 to rotate and adjust the first piston 34 and the second piston 35 for straight reciprocating motion to realize the air compression.

In any embodiment, a side of the base 1 is horizontally and fixedly provided with a mounting base 14.

By mounting the mounting base 14 on a horizontal plane, the base 1 is overall stable. The center of gravity of the four-cylinder compressor is low because of the horizontal opposite arrangement, which lowers the center of gravity of the whole machine and enhances the running stability of the whole machine owing to its cylinders are flat.

Some embodiments can be further optimized based on the above embodiments. The four-cylinder compressor further includes a first support assembly Sand a second support assembly 5. The first support assembly 5 and the second support assembly 5 are respectively arranged at left and right positions of motor body 2, and the first support assembly 5 and the second assembly 5 are located between the motor body 2 and the cam mechanism 3.

Each of the first support assembly 5 and the second support assembly 5 include a fixed plate 51 and a support bearing 52; the fixed plate 51 is fixed on the base 1; the support bearing 52 is arranged on the fixed plate 51; the support bearing 52 is attached to the output shafts 21 of the motor body 2.

The end covers 6 includes a first end cover and a second end cover. The first end cover and the second end cover are fixedly provided at left and right ends of the base 1, and each of the first end cover and the second end cover 6 are provided with a shaft sleeve 61. Two shaft sleeves 61 are coaxially fixed on the output shafts 21 of the motor body 2.

This scheme is to provide a compressor with stable output and effect of noise reduction. The support assembly 5 and the end cover 6 are provided on the output shafts 21 of the motor body 2 and are located at different positions of two output shafts 21 of the same motor body 2, which can provide four support points for the output shafts 21 so that the output of the output shafts 21 is more stable, the first cylinder 41 and the second cylinder 42 under working state can be prevented from driving the output shafts 21 eccentric, and working stability of the output shafts 21 are improved. Besides, it further reduces noise caused by eccentricity, and solves the operation instability and noise problem caused by the eccentricity of the output shafts 21 of existing compressors.

Specifically, the motor body 2 drives the output shafts 21 to drive the cam 31 to rotate, so that the first connecting rod 32 and the second connecting rod 33 arranged on the cam 31 operate crank mechanism movement respectively. The first connecting rod 32 is configured to adjust the compression or relaxation of the first piston 34 so as to adjust the compression of the first cylinder 41, and the second connecting rod 33 is configured to adjust the compression or relaxation of the second piston 35 so as to adjust the compression of the first cylinder 42. The first connecting rod 32 is provided on one side of the second connecting rod 33, and the second connecting rod 33 is provided near the motor body 2. When the motor body 2 starts, the output shafts 21 drive the cam 31 rotate and adjust the first piston 34 and the second piton 35 for straight reciprocating motion to realize effect of the air compression. In this scheme, the support bearing 52 is sleeved on the output shafts 21 of the motor body 2, and is located between the motor body 2 and the cam mechanism 3, which can improve rotation stability of the section of the output shafts 21 between the motor body 2 and the cam mechanism 3. In addition, the end cover 6 is fixedly on the left and right ends of the base 1, and two ends of the two output shafts 21 of the motor body 2 are limited through the shaft sleeve 61 of the end cover 6, so that the ends of the shaft sleeve 61 and the output shafts 21 are coaxially fixed on the output shafts 21 of the motor body; therefore, the output shafts 21 are coaxially limited between the motor body 2 and the cam mechanism 3, and the output shafts 21 are limited at end portion. A gap between the output shafts 21 and other mechanisms will not cause eccentricity of the output shafts 21, so that the operation of the first connecting rod 32 and the second connecting rod 33 will not drive the eccentricity of the output shafts 21. In this way, a combination of the shaft sleeve 61 and the support bearing 52 can improve the output stability of the output shafts 21 so as to reduce the noise caused by the abrasion and eccentricity of the output shafts 21.

The motor body 2 drives the cam mechanism 3 at two ends to move, so that the cam mechanism 3 compress the air in the first cylinder 41 and the air in the second cylinder 42. The four cylinders are divided into the first cylinder group 4 and the second cylinder group 4, and the first cylinder group 4 and the second cylinder group 4 are respectively set on the opposite sides of the base 1. Such a horizontal arrangement makes the center of gravity of the four cylinders be low, which lowers the center of gravity of the whole machine and enhances the running stability of the whole machine; meanwhile, the horizontal arrangement of the four cylinders is a symmetrical and stable structure, which makes the running smoothness of the compressor superior to that of a vertical compressor and that of a V-type compressor, and minimizes the power loss during operation. Certainly, the lower center of gravity and balanced distribution also bring better vibration performance and noise-reduction reliability to the whole machine.

The end cover 6 can be mounted on the end housing 12 by known methods. In this scheme, preferably, a cover edge plate of the end cover 6 is fixed on the end housings 12 by screws, so that the shaft sleeve 61 are coaxially fixed with ends of the output shafts 21. An outer edge of the end cover 6 is provided with the cover edge plate; the cover edge plate is fixedly provided on an opening of the end housing 12 by screws.

In any embodiment, the first end housing and the second end housing are each provided with an accommodating cavity 121 to accommodate the output shafts 21 and the cam mechanism 3. The accommodating cavity 121 has a sealed structure whose inside and outside are separated.

In this embodiment, an inside and an outside of the accommodating cavity 121 are separated, and the accommodating cavity 121 has a high sealing degree. The noise generated by the output shafts 21 and the cam mechanism 3 in the accommodating cavity 121 during working can not pass through the accommodating cavity 121 so as to improve the noise reduction effect of the accommodating cavity 121. In particular, the noise of the fan 8 in the accommodating cavity 121 is further reduced.

In any embodiment, the first end housing and the second end housing are provided with the accommodating cavity 121 to accommodate the output shafts 21 and the cam mechanism 3. A side wall of the accommodating cavity 121 is provided with a function hole 122.

In this embodiment, the function hole 122 provided on the side wall of the accommodating cavity 121 is configured to pass through air, which can further dissipate heat of an interior of the base 1 and the motor body 2 by air enters and exits the function holes 122 so as to improve dissipation effect of the base 1 and motor body 2.

In any embodiment, the base 1 includes a sealing plug 13. The sealing plug 13 is removably arranged in the function hole 122.

Figure 8:
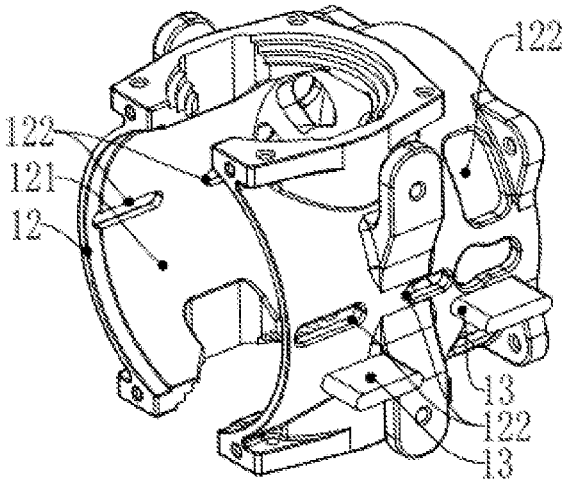
FIG. 8 is a schematic diagram of the end housing according to an embodiment of the present disclosure.
Figure 9:
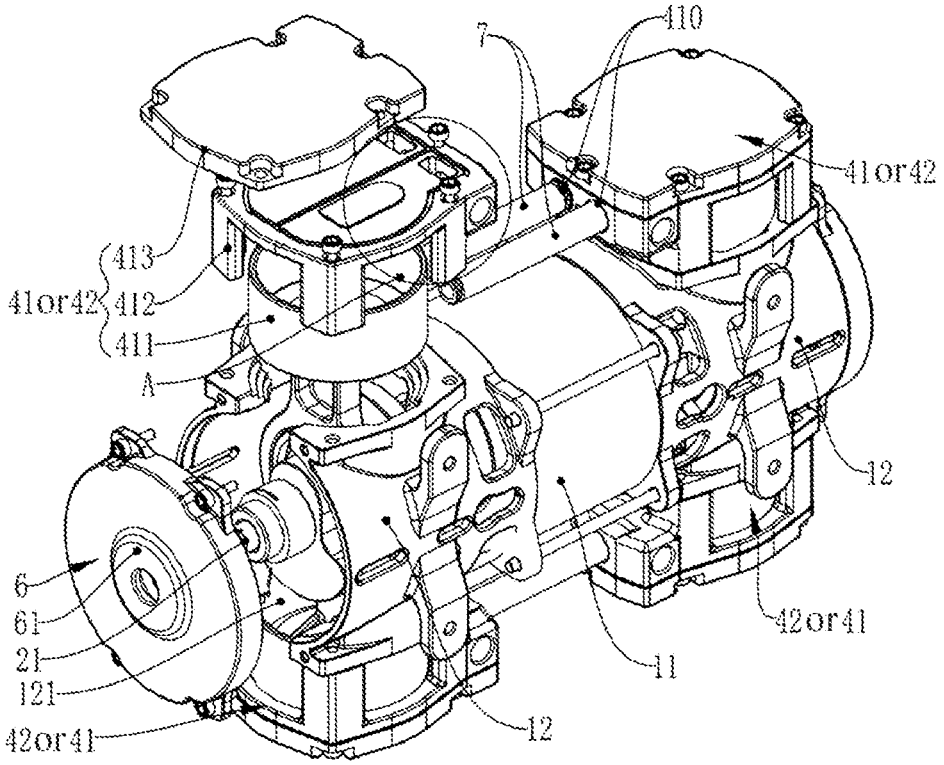
FIG. 9 is an exploded view of the four-cylinder compressor according to an embodiment of the present disclosure.

The sealing plug 13 can be arranged in the function hole 122 as required. After the base 1 completes dissipation, the sealing plug 13 can be arranged in the function holes 122. At this time, the function hole 122 is blocked, and a sealed accommodating cavity 121 form a sealing structure whose inside and outside are separated. On the one hand, it has the effect of noise reduction, on the other hand, it can remove the sealing plug 13 to dissipate heat as required, realize functions of noise reduction and heat dissipation, and further achieve effect of omitting the fan set in the base 1. Meanwhile, a part of the end housing 12 near the motor body 2 can be provided with the function hole 122. For example, as shown in FIG. 8, one of the function holes 122 is exposed to promote the heat dissipation of the motor body 2.

In an embodiment, the first cylinder 41 and the second cylinder 42 each include a cylinder liner 411, a valve plate 412 and a cylinder cover 413.

The cylinder liner 411 of the first cylinder 41 and the cylinder liner 411 of the second cylinder 42 are arranged opposite to each other at the base 1 along a vertical direction; the first piston 34 is arranged in one side of the cylinder liner 411, and the second pistons 35 is arranged in the other side of the cylinder liner 411; the valve plate 412 is arranged in the cylinder liner 411, and the cylinder cover 413 is provided on the valve plate 412; the cylinder cover 413 is provided with an air cavity 414; the valve plate 412 is provided with a cylinder air hole 415 and a gas delivery passage 416 in an area of the air cavity 412;

the cylinder air hole 415 is connected with an interior of the cylinder liner 411 and the air cavity 414. One end of the gas delivery passage 416 is connected with the air cavity 414, and the other end of cylinder liner is connected with outside of the valve plate 412.

The cylinder liner 411 can be arranged on the end housing 12 of the base 1; the gas delivery passage 416 is configured to input or output gas. The gas suction and discharge are performed through the compression and releasing of the first piston 34 or the second piston 35, so as to control the gas input and output through the gas delivery passage 416. An interior of the gas passage 416, the air cavity 414, the cylinder air hole 415 and the cylinder liner 411 are connected successively. When the first piston 34 or the second piston 35 control the first cylinder 41 (or the second cylinder 42) to inhale air, the air is input to the interior of the cylinder liner 411 through the gas delivery passage 416 and the air cavity 414. When the first piston 34 or the second piston 35 control the first cylinder 41 (or the second cylinder 42) to exhaust air, the air is output to outside through the interior of the cylinder liner 411 to the air cavity 414 and the gas delivery passage 416.

In any embodiment, outer walls of the valve plate 412 are respectively provided with an air inlet 417 and an air outlet 418.

In this scheme, the air inlet 417 with inputting air function and the air outlet 418 with outputting air function are integrated on a same valve plate 412. The gas delivery passage 416 can inhale and exhaust air only need to expose the air inlet 417 and the air outlet 418 on the outer wall of the valve plate 412, and it is not necessary to set a joint on outside of the first cylinder 41 or outside of the second cylinder 42. On the one hand, it can further simplify the use of the joint on the basis of not affecting inhaling and exhausting air, on the other hand, it also makes the outside of the first cylinder 41 and the outside of the second cylinder 42 more concise, molds of the first cylinder 41 and the second cylinder 42 easier when forming, cost of molding lower and appearance more concise.

In any embodiment, the four-cylinder compressor further includes a cylinder connecting pipes 7. The valve plate 412 is provided with a connection port 410 on the gas delivery passage 416, and the connection port 410 is located between the air inlet 417 and the air outlet 418. Two ends of the cylinder connecting pipe 7 are connected with the connection port 410 of the valve plate 412 in the two cylinder groups 4.

The cylinder connecting pipes 7 can connect with the first cylinder 41 in the two cylinder groups, and can connect with the second cylinder 42 in the two cylinder groups. The first cylinder 41 of the first cylinder group is communicated with the first cylinder 41 of the second cylinder group. And the second cylinder 42 of the first cylinder group is communicated with the second cylinder 42 of the second cylinder group. In this time, this scheme has a structure of four connected cylinders. It can achieve noise reduction and filtration by only one of the four cylinders needs to be connected with a muffler and a filter. The gas is input or output from one cylinder can enter another cylinder through cylinder connecting pipe 7. Only the air inlet 417 or the air outlet 418 of one cylinder need to be connected with the muffler and the filter, and multiple cylinders share the same muffler and the filter, which can omit other mufflers and filters of other cylinders and further simplify the structure of the four-cylinder compressor.

In any embodiment, the number of the air cavity 414 on the end cover 413 is two; the number of the cylinder air hole 415 on the valve plate 412 is two, and two cylinder air holes are in one-to-one correspondence with two air cavities. The cylinder air hole 415 is connected with an interior of the cylinder liner 411 and the air cavity 414. Every cylinder air hole 415 of the air cavity 414 is provided with a suction plate 419 which can be figured to move to attach to or detach from two cylinder air holes 415 to adjust two ends of the cylinder air holes 415 to be separated or connected.

Figure 10:
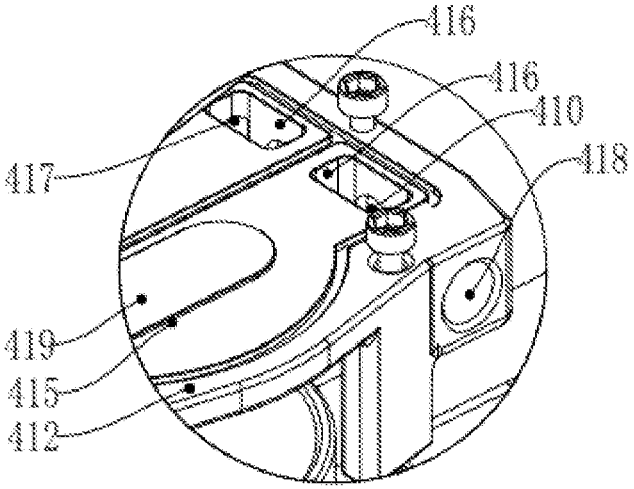
FIG. 10 is an enlarged view of part A in FIG. 9.
Figure 11:
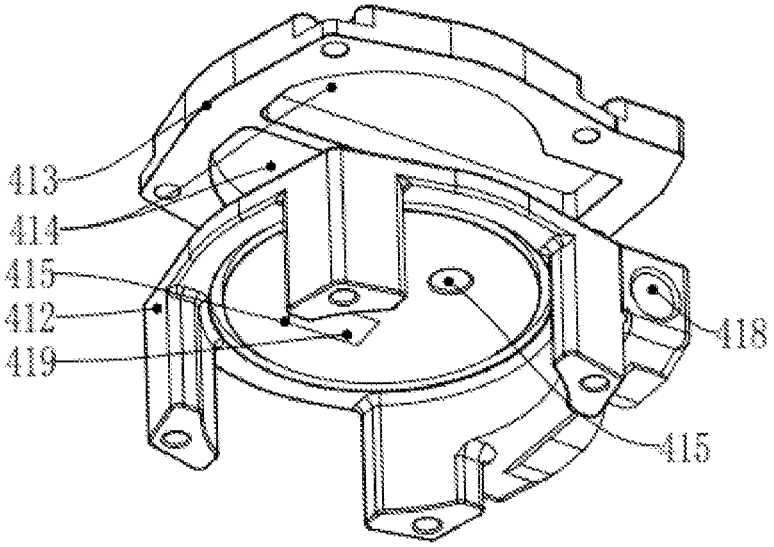
FIG. 11 is an exploded view of the first cylinder or the second cylinder according to an embodiment of the present disclosure.
Figure 12:
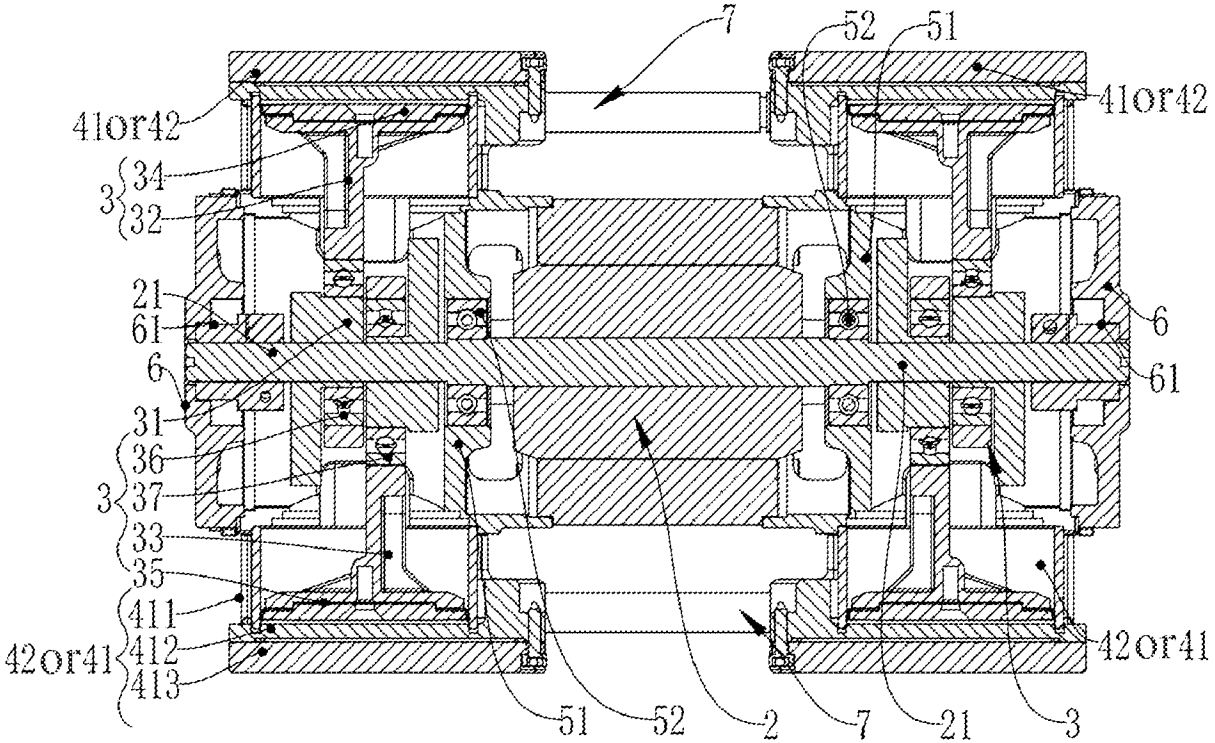
FIG. 12 is a cutaway view of the four-cylinder compressor according to an embodiment of the present disclosure.

When the cylinder liner 411 is inhaling air, after the air passes through the gas delivery passage 416 and the air cavity 414, air pressure of one of the cylinder air cavity 415 of the valve plate 412 will press the suction plate 419 on a surface of the cylinder air hole 415, so that the air in the interior of the cylinder liner 411 can not output through the cylinder air hole 415. The suction plate 419 of another cavity of the valve plate 412 is detached from the cylinder air hole 415 under push of the air pressure, and the air can enter into the interior of the cylinder liner 411 through the cylinder air hole 415, which is an inhale state of this cylinder. Similarly, when the cylinder liner 411 is exhausting gas, the suction plate 419 is detached from the cylinder air hole 415 by the air pressure, then the gas will press the suction plate 419 which originally were in a detached state onto the cylinder air hole 415, and the gas will detach from the suction plate 419 which originally were in a pressed state from the cylinder air hole 416 by air pressure. In this way, the gas in the cylinder liner 411 can enter into the air cavity 414 and the gas delivery passage 416 through the cylinder air hole 415, which is an exhaust state of this cylinder. In one embodiment, as shown in FIGS. 10-11, the valve plate 412 is provided with the cylinder air hole 415 and a corresponding suction plate 419 on front or back surfaces respectively.

In any embodiment, the cam mechanism 3 includes a first bearing 36 and a second bearing 37.

The cam 31 is connected with the first connecting rod 32 through the first bearing 36, and the cam 31 is connected with the second connecting rod 33 through the second bearing 37.

The cam 31 is provided with the first bearing 36 and the second bearing 37. The first connecting rod 32 is sleeved on the first bearing 36, and the second connecting rod 33 is sleeved on the second bearing 37. The arrangement of the first bearing 37 and the second bearing 37 can further improve the smooth connection, low friction and convenient transmission between the first connecting rod 32 and the second connecting rod 33 and the output shafts 21.

In any embodiment, the four-cylinder compressor also includes the fan 8; the fan 8 is fixedly connected with the output shafts 21 of the two ends of the motor body 2.

The output shafts 21 of the two ends of the motor body 2 is in transmission connection with the cam mechanism 3 and the fan 8 successively so as to drive the fan 8 rotate to dissipate heat of the motor body 2 and the base 1. When the fan 8 is arranged in the end housing 12, in some embodiments, the end cover 6 can cover the end housing 12, which can further reduce noise of the fan 8. Meanwhile, the output shafts 21 are limited based on the combination of the support assembly 5 and the end cover 6 of some embodiments. The vibration generated by the fan 8 during operation has limited effect on the output shaft 21 and can be omitted.

The technical principle of the technical solutions of this application has been described above with reference to specific embodiments. It should be understood that the description is only used to explain the principle of the disclosure, and cannot be interpreted as the limitation to the protection scope of the disclosure in any way. Therefore, other embodiments obtained by those skilled in the art based on the content disclosed herein without making creative effort shall fall within the scope of this disclosure defined by the appended claims.

What is claimed is:

1. A four-cylinder compressor, comprising:

a base;

a motor body;

a first cam mechanism;

a second cam mechanism;

a first cylinder group;

a second cylinder group;

a first support assembly;

a second support assembly;

a first cylinder connecting pipe; and a second cylinder connecting pipe;

wherein the base is hollow, and is placed horizontally; the motor body is fixedly arranged in the base; the first cam mechanism and the second cam mechanism are respectively in transmission connection with output shafts at both ends of the motor body; the first cylinder group is arranged on a first side of the base, and the second cylinder group is arranged on a second side of the base opposite to the first side of the base; the first cylinder group is in transmission connection with the first cam mechanism; and the second cylinder group is in transmission connection with the second cam mechanism; and each of the first cylinder group and the second cylinder group comprises a first cylinder and a second cylinder; the first cylinder and the second cylinder are fixed on the base opposite to each other along a vertical direction; the first cylinder of the first cylinder group is communicated with the first cylinder of the second cylinder group; and the second cylinder of the first cylinder group is communicated with the second cylinder of the second cylinder group;

the base comprises a motor housing, a first end housing and a second end housing; the first end housing is arranged at a first side of the motor housing, and the second end housing is arranged at a second side of the motor housing; the motor body is fixedly provided in the motor housing; the first cam mechanism is arranged in the first end housing, and the second cam mechanism is arranged in the second end housing; the first cylinder and the second cylinder of the first cylinder group are arranged opposite to each other at upper and lower sides of the first end housing, respectively; and the first cylinder and the second cylinder of the second cylinder group are arranged opposite to each other at upper and lower sides of the second end housing, respectively;

each of the first cam mechanism and the second cam mechanism comprises a cam, a first connecting rod, a second connecting rod, a first piston and a second piston;

the cam of the first cam mechanism and the cam of the second cam mechanism are respectively fixed on the output shafts of the motor body;

the first connecting rod and the second connecting rod are sleeved on the cam; the first piston is provided on the first connecting rod; the second piston is provided on the second connecting rod; the first connecting rod and the second connecting rod are perpendicular to the output shafts; the second connecting rod is arranged near the motor body; the first piston is in transmission connection with the first cylinder; and the second piston is in transmission connection with the second cylinder;

the first support assembly is arranged at a first side of the motor body, and the second support assembly is arranged at a second side of motor body; the first support assembly is located between the motor body and the first cam mechanism; and the second support assembly is located between the motor body and the second cam mechanism;

each of the first support assembly and the second support assembly comprises a fixed plate and a support bearing; the fixed plate is fixed on the base; the support bearing is arranged on the fixed plate; and the support bearing is sleeved on the output shafts of the motor body;

a first end cover is fixedly provided at a first end of the base, and a second end cover is fixedly provided at a second end of the base; the first end cover is provided with a first shaft sleeve, and the second end cover is provided with a second shaft sleeve; and the first shaft sleeve and the second shaft sleeve are coaxially fixed on the output shafts of the motor body, respectively;

the first cylinder comprises a first cylinder liner, a first valve plate and a first cylinder cover, and the second cylinder comprises a second cylinder liner, a second valve plate and a second cylinder cover;

the first cylinder liner and the second cylinder liner are arranged opposite to each other at the base along a vertical direction; the first piston is arranged in the first cylinder liner, and the second piston is arranged in the second cylinder liner; the first valve plate is arranged in the first cylinder liner, and the second valve plate is arranged in the second cylinder liner; the first cylinder cover is provided on the first valve plate, and the second cylinder cover is provided on the second valve plate; the first cylinder cover is provided with a first air cavity, and the second cylinder cover is provided with a second air cavity; a portion of the first valve plate located within the first air cavity is provided with a first cylinder air hole and a first gas delivery passage, and a portion of the second valve plate located within the second air cavity is provided with a second cylinder air hole and a second gas delivery passage;

the first cylinder air hole is connected with an interior of the first cylinder liner and the first air cavity, and the second cylinder air hole is connected with an interior of the second cylinder liner and the second air cavity; one end of the first gas delivery passage is connected with the first air cavity, and the other end of the first gas delivery passage is connected with outside of the first valve plate; and one end of the second gas delivery passage is connected with the second air cavity, and the other end of the second gas delivery passage is connected with outside of the second valve plate;

outer side walls of the first valve plate are respectively provided with a first air inlet and a first air outlet of the first gas delivery passage;

outer side walls of the second valve plate are respectively provided with a second air inlet and a second air outlet of the second gas delivery passage;

the first valve plate is provided with a first connection port at the first gas delivery passage, and the first connection port is located between the first air inlet and the first air outlet; and one end of the first cylinder connecting pipe is connected with the first connection port corresponding to the first cylinder group, and the other end of the first cylinder connecting pipe is connected with the first connection port corresponding to the second cylinder group; and the second valve plate is provided with a second connection port at the second gas delivery passage, and the second connection port is located between the second air inlet and the second air outlet; and one end of the second cylinder connecting pipe is connected with the second connection port corresponding to the first cylinder group, and the other end of the second cylinder connecting pipe is connected with the second connection port corresponding to the second cylinder group.

2. The four-cylinder compressor of claim 1, wherein a side of the base is horizontally and fixedly provided with a mounting base.

3. The four-cylinder compressor of claim 1, wherein the first end housing and the second end housing are each provided with an accommodating cavity to accommodate the output shafts, the first cam mechanism and the second cam mechanism; and the accommodating cavity has a sealed structure whose inside and outside are separated.

4. The four-cylinder compressor of claim 1, wherein the first end housing and the second end housing are each provided with an accommodating cavity to accommodate the output shafts, the first cam mechanism and the second cam mechanism; and a side wall of the accommodating cavity is provided with a function hole.

5. The four-cylinder compressor of claim 4, wherein the base comprises a sealing plug; and the sealing plug is removably arranged in the function hole.

6. The four-cylinder compressor of claim 1, wherein the first air cavity is configured as two first air cavities; the first cylinder air hole is configured as two first cylinder air holes, and the two first cylinder air holes are in one-to-one correspondence with the two first air cavities; each of the two first cylinder air holes is provided with a first suction plate which is resettable and adjustable; and the first suction plate is configured to move to attach to or detach from the two first cylinder air holes, so as to make two ends of each of the two first cylinder air holes isolated or connected; and the second air cavity is configured as two second air cavities; the second cylinder air hole is configured as two second cylinder air holes, and the two second cylinder air holes are in one-to-one correspondence with the two second air cavities; each of the two second cylinder air holes is provided with a second suction plate which is resettable and adjustable; and the second suction plate is configured to move to attach to or detach from the two second cylinder air holes, so as to make two ends of each of the two second cylinder air holes isolated or connected.

7. The four-cylinder compressor of claim 1, wherein each of the first cam mechanism and the second cam mechanism comprises a first bearing and a second bearing; and the cam is connected with the first connecting rod through the first bearing, and the cam is connected with the second connecting rod through the second bearing.

8. The four-cylinder compressor of claim 1, further comprising:

fans fixedly connected with the output shafts respectively.

* * * * *